United States Patent [19]

Assmus et al.

[11] 4,276,634

[45] Jun. 30, 1981

[54] BATTERY OPERATED CLOCK

[75] Inventors: Friedrich Assmus; Hans Flaig, both of Schramberg; Robert Wolber; Roland Maurer, both of Lauterbach, all of Fed. Rep. of Germany

[73] Assignee: Gebruder Junghans GmbH, Schramberg, Fed. Rep. of Germany

[21] Appl. No.: 68,595

[22] Filed: Aug. 22, 1979

[30] Foreign Application Priority Data

Sep. 12, 1978 [DE] Fed. Rep. of Germany ..... 2839554

[51] Int. Cl.[3] ..... G04B 37/00

[52] U.S. Cl. ..... 368/300; 368/204; 368/276

[58] Field of Search ..... 29/625, 626; 361/400, 361/403; 310/40 MM, 49 R, 162–164, 258; 368/276, 300, 204

[56] References Cited

U.S. PATENT DOCUMENTS

| | | | |
|---|---|---|---|
| 2,912,481 | 11/1959 | Backus et al. | 29/626 |
| 3,981,139 | 9/1976 | Jackle | 58/23 R |
| 4,121,413 | 10/1978 | Kissinger et al. | 58/23 R X |
| 4,175,374 | 11/1979 | Yoshizawa | 58/23 R |

*Primary Examiner*—Ulysses Weldon

*Attorney, Agent, or Firm*—Burns, Doane, Swecker & Mathis

[57] ABSTRACT

A clock is disclosed comprising a housing which includes mounts for supporting clockhands, and a clockwork for driving the hands. The clock also includes a motor, an electronic circuitry for conducting electrical power to the motor, and a circuit board. The motor includes a coil, a stator, and a rotor. The circuit board includes means for carrying the electronic circuitry, coil and stator externally of the housing to form a preassembled module which can be pushed into the housing into contact with respective retaining parts on the housing.

9 Claims, 13 Drawing Figures

BATTERY OPERATED CLOCK

RELATED APPLICATIONS

The related disclosures of the following copending U.S. applications, filed simultaneously herewith, are incorporated herein by reference as if set forth at length:

1. U.S. application No. 68,591 by Robert Wolber et al (corresponding to German Application No. G 78 27 035.6 filed Sept. 12, 1978).
2. U.S. application No. 68,590 by Robert Wolber et al (corresponding to German Application No. G 78 27 030.1 filed Sept. 12, 1978).
3. U.S. application No. 68,620 by Robert Wolber et al (corresponding to German Application No. G 78 27 031.2 filed Sept. 12, 1978).
4. U.S. application No. 68,619 by Hans Flaig et al (corresponding to German Application No. P 28 39 611.4-34 filed Sept. 12, 1978).
5. U.S. application No. 68,598 by Roland Maurer (corresponding to German Application No. G 78 27 034.5 filed Sept. 12, 1978).
6. U.S. application No. 68,597 by Udo Schultheiss (corresponding to German Application No. G 78 27 033.4 filed Sept. 12, 1978).
7. U.S. application No. 68,596 by Robert Wolber et al (corresponding to German Application No. P 28 39 555.3-31 filed Sept. 12, 1978).

BACKGROUND OF THE INVENTION

The invention concerns an electrically operated clock. In the case of known clocks, elements for supporting the various components of the clockwork are arranged on two base plates which also form sections of the clock housing. The individual parts of the clockwork are mounted and fastened to these supporting elements in a certain sequence whereby the assembly of the multitude of individual components of the clockwork results in a rather substantial installation effort.

It is, therefore, an object of the invention to improve a clock of the type discussed above whereby the number of components of the clockwork requiring individual installation as well as the number of fastening elements are reduced.

SUMMARY OF THE INVENTION

The invention achieves this object by means of a clock comprising a housing which includes mounts for supporting clockhands and a clockwork for driving the hands. The clock also includes a motor, an electronic circuitry for conducting electrical power to the motor, and a circuit board. The motor includes a coil, a stator and a rotor. The circuit board includes means for carrying the electronic circuitry, coil and stator externally of the housing to form a pre-assembled module which can be pushed into the housing into contact with respective retaining means on the housing.

The invention reduces in an advantageous manner the number of parts requiring individual installation in the clockwork casing. Furthermore, the specific design of the insertable module and of various other parts of the clockwork, proposed by the invention, makes the use of individual fastening means such as bolts and the like entirely unnecessary.

BRIEF DESCRIPTION OF THE DRAWINGS

The invention is described below in detail with reference to a preferred embodiment thereof which is illustrated by the accompanying drawings, wherein.

DETAILED DESCRIPTION OF A PREFERRED EMBODIMENT OF THE INVENTION

Figure 1:
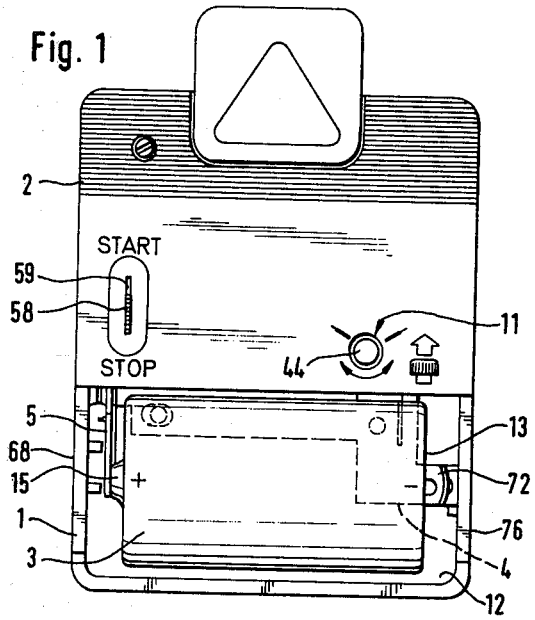
FIG. 1 is a rear view of a clock with the battery exposed.

A clock illustrated in these figures includes a front housing section 1 and a rear housing section 2, both formed from synthetic material such as plastic by injection molding. The housing sections 1, 2 are connected with each other by means of the usual molded projections and recesses and are thus coupled by mechanical force. The clock has a series of components which are arranged within the housing, viz., a battery 3, a negative contact spring 4, a positive contact plate 5, a circuit board 6 with an electronic circuitry 7, a stepping motor 8, a gear system 9, a dividing plate 10 and a clockhand-adjusting device 11.

The battery 3 is inserted in the front housing section 1 where a separate battery compartment 12 is provided. The electrical connection between the negative terminal 13 of the battery and the associated path 14 (see FIG. 10) of the circuit board 6 is made by the negative contact spring 4, while the connection between the positive terminal 15 of the battery with the associated path 16 of the circuit board (see FIGS. 10 and 11) is accomplished by the positive contact plate 5.

Figure 12:
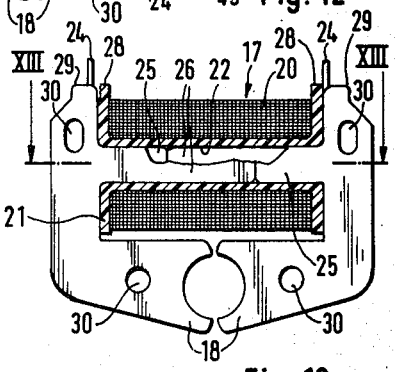
FIG. 12 is a top view of the static parts of a stepping motor used in the clockwork.
Figure 13:
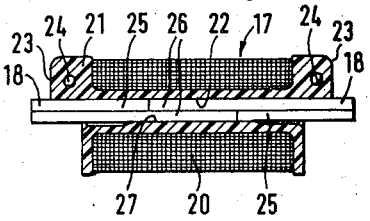
FIG. 13 is a sectional view taken along line XIII—XIII of FIG. 12 through the stepping motor.

The stepping motor comprises, as illustrated in FIG. 12 and 13, a coil 17, two stacks of stator laminations 18 and a rotor 19. The coil itself comprises a coil former 21 formed of synthetic material and which carries a winding 20 and two lateral flanges, the latter carrying projections 23 with coil terminal pins 24. The coil former 21 is provided with a through-bore 22 to accommodate the two stacks of stator laminations 18. Each stack 18 comprises two stator laminations with positioning arms 25 and 26, respectively, of different lengths which engage the through-bore 22 of the coil former 21 and are mounted therein by encircling each other. The laminations are laterally retained by a pressing extension 27 of the coil former which protrudes radially into the through-bore 22. The coil former 21, as well as the stator laminations, are provided with laterally extending positioning projections 28 and 29 which serve to hold these components in their proper position. The stator laminations are further provided with several bores 30 which perform the same positioning function.

The gear system which moves the clock hands of the clock will now be described with reference to FIG. 2.

An intermediate gear wheel 32, whose pinion 33 is geared with the second-indicating wheel 34, meshes with the pinion 31 of the rotor. A pinion 35, arranged on the second-indicating wheel 34, engages the tooth system of a small base wheel 36.

The parts 32 to 36 of the gear system are arranged within the area between the rear housing section 2 and the dividing plate 10.

Figure 3:
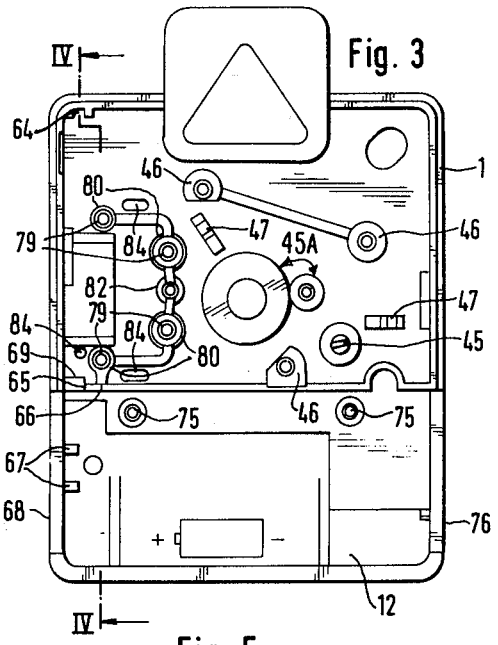
FIG. 3 is a rear view of the clock with the clockwork removed.

A pinion 37 of the small base wheel 36 meshes with teeth of a minute indicating wheel 38. A pinion 39 of the wheel 38 engages a change gear 40. A pinion 41 of the gear 40 meshes with an hour-indicating wheel 42. A geared regulating wheel 43, which is a component of a clockhand-adjusting mechanism, engages the pinion 39 of the minute-indicating wheel 38. This wheel 43 and pinion 39 are connected with each other by means of a friction coupling which makes possible a relative motion of these two gear components when the clockhands are reset. The regulating wheel 43 can engage a pinion which is seated at an axially movable clockhand-adjusting shaft 44. The latter is mounted on a bearing bolt 45, which is fastened to the front housing section 1 (see FIG. 3). The bolt 45 passes through bores of the dividing plate 10 and the rear housing section 2 so that it can be operated manually from outside of the housing.

These parts 37 to 43 of the gear system are arranged within the area between the separating plate 10 and the front housing section 1.

Bearing mounts 45A are provided on two housing sections 1 and 2 as well as on the dividing plate 10 for the mounting of the gear system. The dividing plate 10 rests on supports 46 (see FIG. 3) which are connected with the front housing section 1. The axial positioning of the dividing plate 10 is accomplished by elastic supports 47 (see FIG. 3) which are connected to the front housing section 1 and which include laterally projecting notches which project through openings in the dividing plate to engage a rear surface thereof (see FIG. 2).

Figure 7:
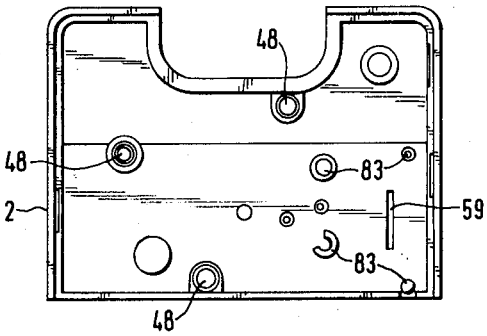
FIG. 7 is a front view of a rear housing section.

In order to insure a precise positional alignment of the bearing mounts of the front housing section 1 and the dividing plate 10 with the mounts of the rear housing section 2, there are attached to the latter bearing lugs 48 (see FIG. 7) which are engaged by pins formed at outer ends of the supports 46 carrying the dividing plate 10.

Figure 8:
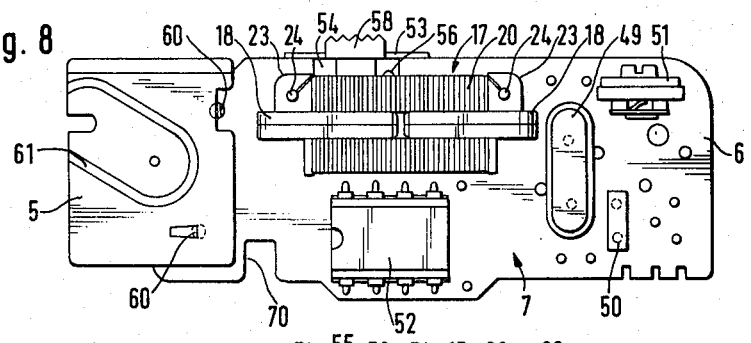
FIG. 8 is a front view of an insertable module after pre-assembly in accordance with the invention.
Figure 9:
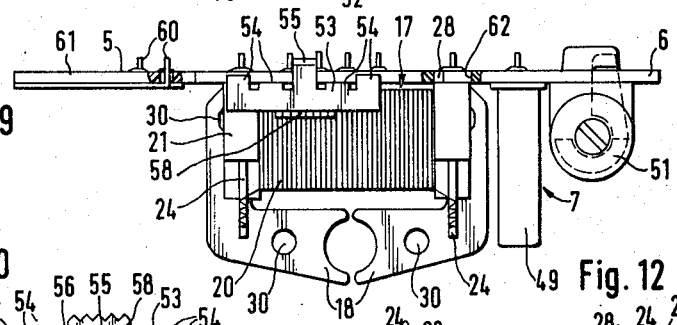
FIG. 9 is a top view of the insertable module shown in FIG. 8.

The circuit board 6 is printed on one side and carries on its non-printed side the components of the electronic circuitry 7 which supplies the timing pulses for the drive of the stepping motor 8. This circuitry 7 comprises (as shown especially in FIG. 8) a quartz resonator 49, a fixed capacitor 50, a trimmer capacitor 51 and an integrated circuit 52. The terminals of these components pass through bores of the circuit board 6 and are soldered at its printed side to the appropriate electric paths.

Figure 10:
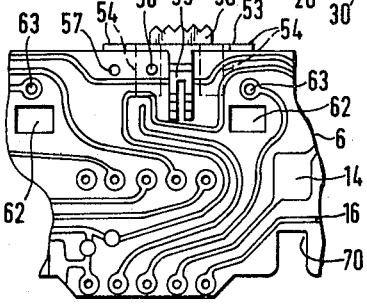
FIG. 10 is a partial rear view of the insertable module illustrated in FIG. 8.
Figure 11:
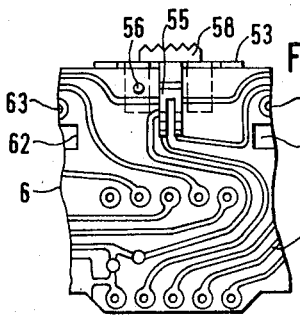
FIG. 11 is another partial rear view of the insertable module illustrated in FIG. 8.

The circuit board 6 carries, in accordance with the present invention, in addition to the components of the electronic circuitry 7, also parts of the clockwork, including the static components of the stepping motor. These additional components and the components of the circuitry form, in conjunction with the circuit board 6, an insertable module which can be pre-assembled externally of the housing and then inserted into the housing into correspondingly designed retaining elements. The parts to be fastened on the circuit board 6, in addition to the elements of circuitry 7, are the coil 17, the two stacks of stator laminations 18 of the stepping motor 8, the positive contact plate 5 and a slide switch 53. The latter makes or breaks the pulse feed from the integrated circuit 52 to the coil 17 of the stepping motor 8. This slide switch 53 is designed in the form of a punched-out, flexible metal part and can be moved along one edge of the circuit board 6 to at least two different positions, i.e., the circuit making and breaking positions. The switch includes a plurality of guide elements 54 which rest guidingly against an edge of the circuit board 6 as well as against the nonprinted side of the board. A clamping effect is accomplished by springy contact arms 55 which grip the printed side of the circuit board and releasably contact two paths of this board. FIG. 10 depicts the position of the slide switch at the time when pulses are transmitted to the stepping motor, while in the switch position illustrated in FIG. 11, two paths of the board are short-circuited or shunted, thus interrupting the pulse feed from the integrated circuit to the stepping motor. A releasable latching of the slide switch 53 in its two positions is accomplished by means of a nipple 56 attached to the switch and which engages one of two bores 57 of the circuit board 6. The slide switch is operated manually by means of a grip 58 which is attached to it and which protrudes through a slot 59 of the rear housing section 2 (see FIGS. 1 and 7).

The positive contact plate 5 (FIG. 8) comprises a punched-out, flexible metal part; it is electrically as well as mechanically connected to the board 6 by means of two angled parts 60 which pass through bores of the circuit board 6 and are soldered to the electric path 16 as well as to one other path. The positive contact plate 5 is further provided with an inward recess 61 in the form of a slanted groove which accommodates the axially projecting positive terminal 15 of the battery 3 (see FIG. 2). The slanted design of the recess 61 makes any changes in the lay-out unnecessary if a battery of smaller diameter is being used because then only the shape of the battery compartment 12 in the front section 1 of the casing has to be modified.

For the purpose of holding the coil 17 and the two stacks of stator laminations 18 in their proper position at the circuit board 6, there are provided on this board two apertures 62 (see FIGS. 10 and 11) with a rectangular profile. Above these apertures are disposed two bores 63 which accommodate the coil terminal pins 24. The apertures 62 are penetrated by the positioning projections 28 and 29 which are attached to the coil and the two stacks of stator laminations. Initially, the stacks of stator laminations are preliminarily loosely mounted within the coil. Then the coil terminal pins are soldered to the appropriate paths of the board 6. The stacks of stator laminations are thus positively, albeit loosely, connected to the circuit board 6.

Figure 2:
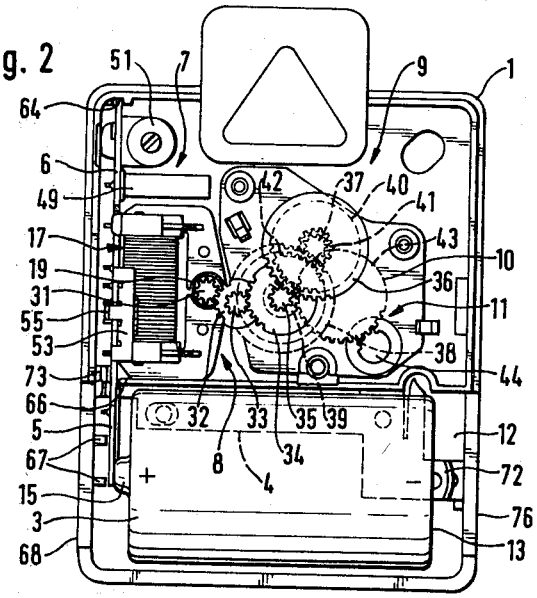
FIG. 2 is a rear view of the clock with a rear housing section removed.

The circuit board 6, which forms together with all clock components fastened to it an insertable module, is placed into the housing parallel with the clockhand axis, as shown especially in FIG. 2. The circuit board 6 is held in place within the front housing section 1 by means of various retaining elements. In particular, the board 6 is laterally controlled by a guiding slot 64 and one end plane 65 (see FIG. 3) of a wall 66 which closes off the battery compartment 12. The area of the circuit board carrying the positive contact plate 5 rests against pressure ribs 67 which are attached to one wall 68 of the front housing section 1. The circuit board is secured in its longitudinal direction by a transversal rib 69 at the bottom of the front housing section 1 which engages a corresponding recess 70 (see FIG. 8) in the circuit board 6.

Figure 5:
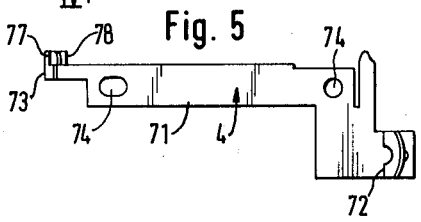
FIG. 5 shows a battery contact element in plan view.
Figure 6:
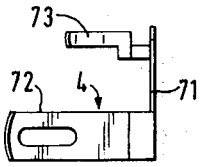
FIG. 6 is a side view of the battery contact element.

The circuit board 6 is positively coupled by the negative contact spring 4 which is illustrated in detail in FIGS. 5 and 6. The spring is formed by a punched-out, flexible metal part and has two angled parts which extend from a bus portion 71 and which form a first contact finger 72 and a second contact finger 73. Within the bus 71 there are provided apertures 74 which are penetrated by fastening pins 75 located within the battery compartment at the bottom of the front section 1 of the casing, for the purpose of holding the negative contact spring 4 in place. The first contact finger 72 rests against the negative terminal of the battery and also against a wall 76 of the front housing section 1. The second contact finger 73 is bent in an S-shape and includes one portion 77 which bears against the wall 68 of the front housing section and a portion 78 which bears against a path 14 of the circuit board 6. These parts of the second contact finger 73 form a knife-edge contact and are resiliently deformed during the insertion of the circuit board into the housing section 1 in such manner that a sufficient force component is created between wall 68 and the circuit board 6 as well as between circuit board 6 and the end plane 65 at wall 66.

Figure 4:
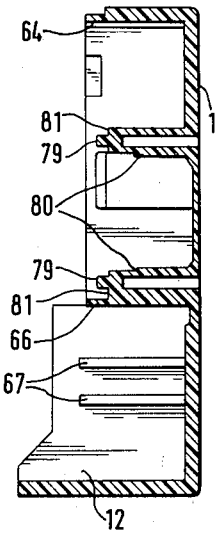
FIG. 4 is a sectional view of a front section of the housing taken along line IV—IV in FIG. 3.

During the insertion of the circuit board 6 into the front housing section 1, the stacks of stator laminations 18, which had been mounted at the board only loosely and preliminarily, are now placed into their proper position relative to each other as well as relative to the rotor 19 by means of positioning pins 79. The pins 79 enter bores 30 of the stator laminations (see FIG. 3). These positioning pins, especially as illustrated in FIG. 4, define outer ends of support posts 80 which are attached to the front housing section 1, which posts also carry seating shoulders 81 for axially supporting the seated stacks of stator laminations 18. Still another support 82 (see FIG. 3) is attached to the front housing section 1 and carries a bearing element for the rotor 19. With the circuit board 6 mounted by mechanical forces inside the front housing section 1 and the stacks of stator laminations resting with a slight friction on the positioning pins 79 of the supports, the rear housing section 2 is applied, which contains abutments 83 (see FIG. 7) in order to secure these components.

Finally, there are provided in the front housing section a number of openings 84 (see FIG. 3) which permit the introduction of an ejection tool for the simple removal of the circuit board and the clock components arranged thereon.

Although the invention has been described in connection with a preferred embodiment thereof, it will be appreciated by those skilled in the art that additions, substitutions, modifications, and deletions not specifically described may be made without departing from the spirit and scope of the invention as defined in the appended claims.

What is claimed is:

1. An electrically operated movement in a clock, said movement comprising:

a multi-section housing including first and second relatively separable housing sections;

said first housing section carrying a plurality of bearing elements, positioning pins, guides, and support posts;

a dividing plate disposed between the housing sections and mounted on said support posts;

a plurality of hand-driving gears are disposed between said dividing plate and said first housing section and have shafts mounted in said bearing elements and in said dividing plate;

a circuit board mounted in said guides and being insertable in a direction parallel to said gear shafts and parallel to a direction of insertion of said dividing plate;

a stepping motor mounted to said circuit board, said motor comprising a coil, a stator, and a rotor, said stator including holes receiving said positioning pins;

said rotor mounted on a shaft which is positioned in one of said bearing elements, said coil being electrically connected to electric circuitry on said circuit board to be energized thereby;

intermediate gear means disposed between said dividing plate and said second housing section and operatively connecting said rotor with said hand-driving gears;

said dividing plate and hand-driving gears being completely offset relative to said circuit board, coil and stator in a direction perpendicular to said gear shafts.

2. Apparatus according to claim 1, wherein some of said shafts bear against said second housing section which defines an axial stop therefor, said second housing section including lugs which receive outer ends of said support posts.

3. Apparatus according to claim 1, wherein a battery compartment is defined in a portion of said first housing section, a battery contact plate is electrically and mechanically connected with said circuit board and extends into a front area of said battery compartment, a battery contact spring has a first end terminating opposite said contact plate to constrain a battery therebetween, said contact spring has another end formed as a tongue which presses said circuit board against a wall of said first housing section to secure said circuit board in position and to make electrical connection with the circuitry thereon.

4. Apparatus according to claim 3, wherein the contact plate is supported in a direction parallel to the axis of the battery by at least one supporting rib formed on the wall of the first housing section.

5. Apparatus according to claim 3, wherein said contact plate contains a battery-receiving recess disposed at a slant with respect to the direction of the insertion of the circuit board.

6. Apparatus according to claim 1, wherein a slide switch for energizing said motor is clamped onto a longitudinal edge of said circuit board so as to be capable of movement along said longitudinal edge.

7. Apparatus according to claim 6, wherein the slide switch is provided with guide portions which engage said circuit board along said longitudinal edge and both sides of said board, one guide portion comprising a spring contact arm for electrically bridging adjacent conductor paths on the laminated surface of the circuit board.

8. Apparatus according to claim 7, wherein a locating nipple is provided on the slide switch, which nipple selectively engages in bore holes of the circuit board to define the position of the switch.

9. Apparatus according to claim 6, wherein a manual handle is provided on the slide switch parallel to the plane of the circuit board, into and through a longitudinal slit in said second housing section.

* * * * *